US009904305B2

(12) United States Patent
Brown et al.

(10) Patent No.: US 9,904,305 B2
(45) Date of Patent: Feb. 27, 2018

(54) VOLTAGE REGULATOR WITH ADAPTIVE BIAS NETWORK

(71) Applicant: Cavium, Inc., San Jose, CA (US)

(72) Inventors: Jonathan K. Brown, Boston, MA (US); JingDong Deng, Acton, MA (US)

(73) Assignee: Cavium, Inc., San Jose, CA (US)

( * ) Notice: Subject to any disclaimer, the term of this patent is extended or adjusted under 35 U.S.C. 154(b) by 0 days.

(21) Appl. No.: 15/143,302

(22) Filed: Apr. 29, 2016

(65) Prior Publication Data

US 2017/0315574 A1 Nov. 2, 2017

(51) Int. Cl.
*G05F 1/575* (2006.01)
*G05F 1/46* (2006.01)

(52) U.S. Cl.
CPC ..... *G05F 1/575* (2013.01); *G05F 1/467* (2013.01); *G05F 1/468* (2013.01); *G05F 1/462* (2013.01)

(58) Field of Classification Search
CPC ..... G05F 1/465; G05F 1/467; G05F 1/468; G05F 1/56; G05F 1/575
See application file for complete search history.

(56) References Cited

U.S. PATENT DOCUMENTS 6,157,176 A * 12/2000 Pulvirenti ..... G05F 1/565 323/266
7,323,853 B2 1/2008 Tang et al.
8,054,052 B2 * 11/2011 Noda ..... G05F 1/575 323/265
8,233,250 B2 7/2012 Burns et al.
8,665,021 B2 3/2014 Reisiger
2005/0248331 A1 * 11/2005 Whittaker ..... G05F 1/575 323/313
2006/0055420 A1 * 3/2006 Luo ..... G05F 1/565 326/33

(Continued)

OTHER PUBLICATIONS

M. Day, "Understanding low drop out LDO regulators," Texas Instruments, Dallas, May 2002. [Online]. Available: http://focus.ti.com/ download/trng/docs/seminar/Topic%209%20-%20Understanding%20LDO%20dropout.pdf.

(Continued)

*Primary Examiner* — Fred E Finch, III
(74) *Attorney, Agent, or Firm* — Hamilton, Brook, Smith & Reynolds, P.C.

(57) ABSTRACT

A low drop-out voltage regulator includes an error amplifier that generates an amplified error voltage, the error amplifier including a first input for receiving a reference voltage, a second input for receiving a feedback voltage, a bias terminal for receiving an adaptive bias current, and an output. A pass gate providing an output voltage includes a first input connected to a supply voltage and a second input connected to the error amplifier output. A feedback network generating the feedback voltage includes a first terminal connected to the output of the pass gate and a second terminal connected to the second input of the error amplifier. An adaptive bias network providing the adaptive bias current includes a first transistor connected to the bias terminal of the error amplifier, a second transistor connected to the first transistor as a current mirror, and a third transistor connected in parallel with the pass gate.

6 Claims, 5 Drawing Sheets

(56) References Cited

U.S. PATENT DOCUMENTS

| | | | | |
|---|---|---|---|---|
| 2008/0224675 | A1* | 9/2008 | Takagi | G05F 1/565 323/275 |
| 2010/0079121 | A1* | 4/2010 | Yanagawa | G05F 1/575 323/277 |
| 2014/0070778 | A1* | 3/2014 | Nihei | G05F 1/575 323/271 |
| 2015/0130427 | A1* | 5/2015 | Chou | G05F 1/46 323/269 |
| 2015/0220096 | A1* | 8/2015 | Luff | G02F 1/1368 327/109 |
| 2015/0311691 | A1* | 10/2015 | Sugiura | G05F 1/56 323/280 |
| 2016/0048148 | A1* | 2/2016 | Lee | G05F 1/575 323/280 |

OTHER PUBLICATIONS

E. Sanchez-Sinencio, "Low drop-out linear regulators: Design considerations and trends for high power supply rejection (PSR)", Proc. IEEE Santa Clara Valley Solid State Circuits Soc., pp. 1-47, 2010.

* cited by examiner

VOLTAGE REGULATOR WITH ADAPTIVE BIAS NETWORK

BACKGROUND

On-chip voltage regulation is a challenge in integrated circuits (ICs). Low-dropout (LDO) voltage regulators create a custom, stepped-down voltage inside of an IC. They must remain stable while adapting to varying load currents and reducing the amount of noise at the output. The dropout voltage is the minimum voltage required across the regulator to maintain regulation. One common use for a voltage regulator is to provide a low-noise, custom voltage for a phase-locked loop (PLL). Modern communication protocols have very stringent specifications on PLLs, which rely on good voltage regulation to share some of the burden of satisfying these specifications. Beyond low noise generation across significant load variation, a good voltage regulator provides high power supply rejection (PSRR), so that the output voltage remains constant across a broad range of input voltages. In addition, the regulator should be energy efficient—ideally, consuming no power itself. Finally, process, voltage, and temperature (PVT) variation will change the performance of the transistors in ICs. The regulator design must be robust to these sources of variation.

SUMMARY

The present disclosure relates to an LDO voltage regulator with an adaptive bias network that adapts to output load currents to provide stable, efficient operation across PVT variation.

Accordingly, an LDO voltage regulator includes an error amplifier configured to generate an amplified error voltage, the error amplifier having a first input terminal for receiving a reference voltage, a second input terminal for receiving a feedback voltage, a current bias terminal for receiving an adaptive bias current, and an output terminal. A pass gate is configured to provide an output voltage to at least one external component, the pass gate having a first input terminal, a second input terminal and an output terminal, the first input terminal of the pass gate being connected to a supply voltage and the second input terminal being connected to the output terminal of the error amplifier. A voltage feedback network is configured to generate the feedback voltage, the voltage feedback network having a first terminal connected to the output terminal of the pass gate and a second terminal connected to the second input terminal of the error amplifier. An adaptive bias network is configured to provide the adaptive bias current to the error amplifier, the adaptive bias network having a first transistor, a second transistor, and a third transistor, the first transistor connected to the current bias terminal of the error amplifier, the second transistor connected to the first transistor as a current mirror, and the third transistor connected in parallel with the pass gate.

In one aspect, the adaptive bias current through the first transistor is proportional to a current through the second transistor, a current through the third transistor is proportional to an output load current, and a current through the error amplifier scales proportionally with the output load current.

In some embodiments, the LDO voltage regulator may include an auxiliary bias network connected to the error amplifier to prevent bistable operation.

In some embodiments, the error amplifier may include a diode-connected transistor connected to the output terminal of the error amplifier that is configured to have a size selected to enhance bandwidth of the amplifier.

In some embodiments, the adaptive bias network may include a resistor-capacitor network configured to provide stability to the adaptive bias network.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments of the invention follows.

Figure 1:
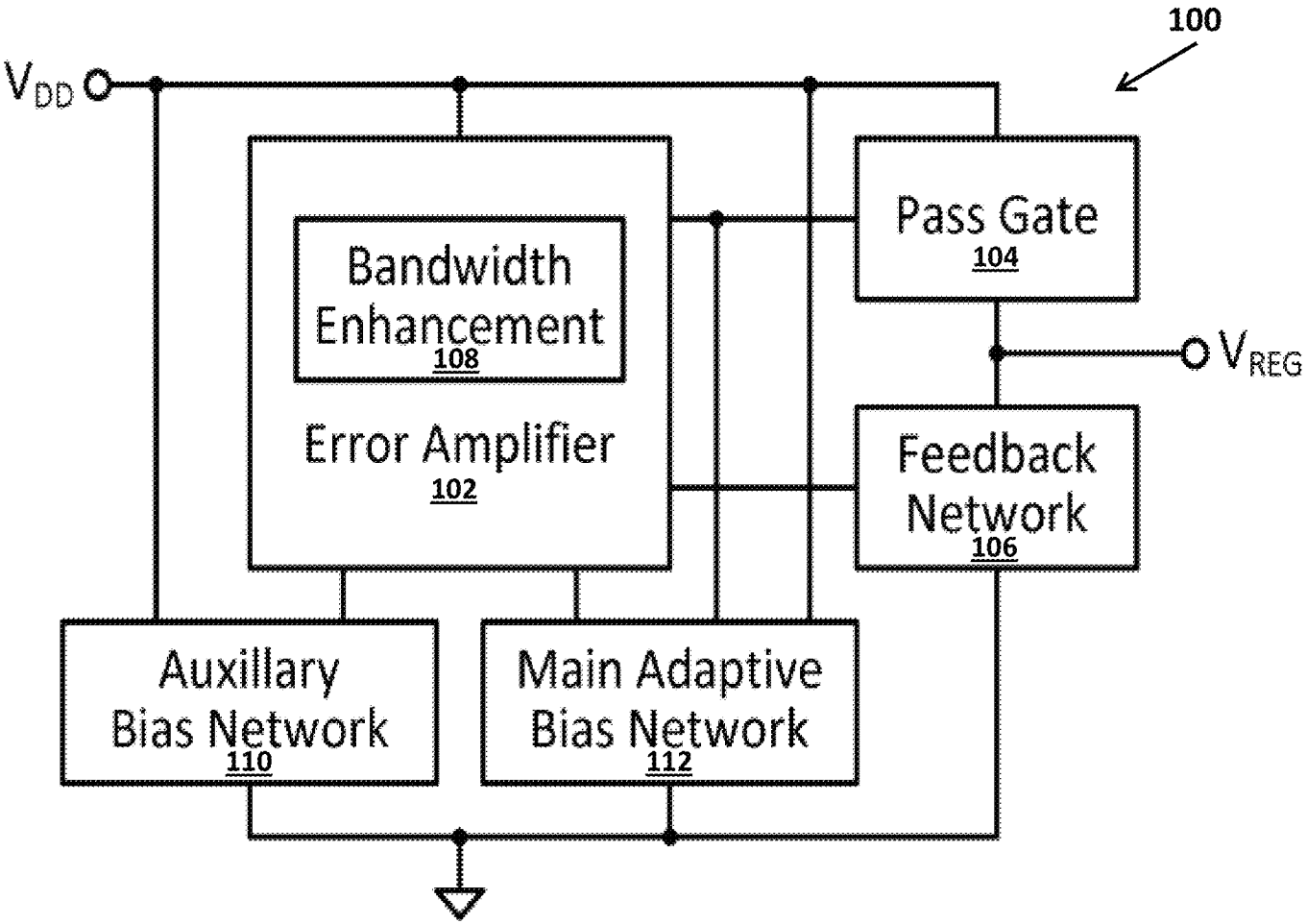
FIG. 1 is a block diagram of an example embodiment of an LDO voltage regulator.

FIG. 1 is a block diagram of an example embodiment of an LDO voltage regulator 100. The LDO regulator 100 steps-down an input supply voltage, $V_{DD}$, to a smaller regulated output voltage, $V_{REG}$ through pass gate transistor 104 to provide a regulated voltage to one or more external components (not shown). The LDO voltage regulator 100 includes an error amplifier 102 with bandwidth (BW) enhancement 108, pass gate transistor 104, a resistor-based feedback network 106, and current biasing with an auxiliary bias network 110 and main adaptive bias network 112.

The regulated output $V_{REG}$ has load current $I_L$ and load capacitance $C_L$ which affect the stability of the regulator. The regulated output $V_{REG}$ is also fed back around to the pass gate transistor 104 through the resistor-based voltage feedback network 106, and the error amplifier 102. Assuming a large loop gain, then the regulated output voltage is generally given by:

$$V_{REG} = \frac{V_{FB}}{\beta} = \frac{V_{REF}}{\beta} = V_{REF}\frac{R_1 + R_2}{R_2}$$

Figure 2:
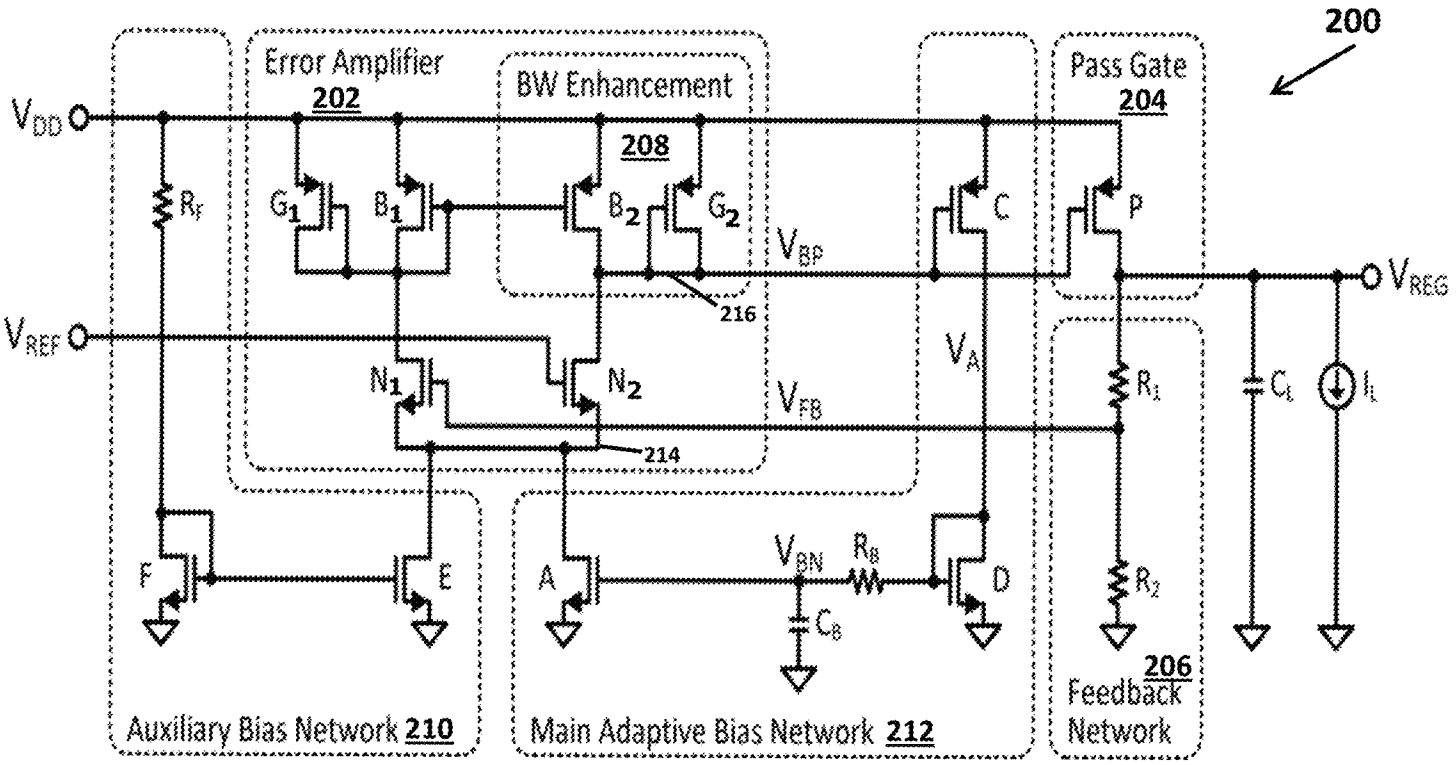
FIG. 2 is a circuit diagram of the example embodiment of FIG. 1.

FIG. 2 is a circuit diagram 200 of the example embodiment of FIG. 1. The input supply voltage $V_{DD}$ passes through pass gate transistor P 204 to the regulated output $V_{REG}$. The regulated output voltage also includes voltage feedback network 206, including $R_1$ and $R_2$, load capacitance $C_L$, and load current $I_L$.

Transistor pair $G_1$, $G_2$, transistor pair $B_1$, $B_2$, and transistors C, and P are PMOS transistors which have their respective source terminals connected to supply voltage $V_{DD}$. The remaining transistors F, E, pair $N_1$, $N_2$, A, and D are NMOS transistors.

Error amplifier 208 includes transistor pair $N_1$, $N_2$, transistor pair $B_1$, $B_2$, and transistor pair $G_1$, $G_2$. Reference voltage $V_{REF}$ connects to the gate terminal of transistor $N_2$.

Feedback voltage $V_{FB}$ is fed back from feedback network 206 to the gate terminal of transistor $N_1$. The drain terminal of transistor $N_1$ is connected to the drain and gate terminals of transistors $B_1$ and $G_1$. The drain terminal of transistor $N_2$ is connected to the drain terminals of transistors $B_2$ and $G_2$ and the gate terminal of transistor $G_2$ which provides the output for the error amplifier 202.

Pass gate transistor P 204 outputs $V_{REG}$ at its drain terminal. The gate terminal of transistor P is connected to the respective gate terminals of transistors C and $G_2$ and the drain terminals of $B_2$, $G_2$, and $N_2$.

A resistive divider is employed as the feedback network 206. The resistive divider includes resistor $R_1$ and resistor $R_2$ connected in series. The resistors $R_1$, $R_2$ can scale down the output voltage $V_{REG}$ according to different values of resistors $R_1$, $R_2$ and feed a voltage $V_{FB}$ lower than $V_{REG}$ back to the gate terminal of the transistor $N_1$.

Transistors C, D, and A form an adaptive bias network 212 that increases DC loop gain and saves power. Transistor A provides the error amplifier 202 with most of its bias current through a common mode connection to node 214 connecting the source terminals of transistor pair $N_1$, $N_2$. The bias current connects to a current mirror (diode-connected transistor D), so that the current through transistor A is proportional to the current through transistor D. The respective source terminals of transistors A and D are connected to ground. The drain terminal of transistor D is connected to the drain terminal of transistor C. Transistor C is connected in parallel with the pass gate transistor P at node $V_{BP}$. As a result, the current through transistor C is proportional to the output load current $I_L$ as it varies in time. Because the current through C is proportional to $I_L$ and the current through A is proportional to D, the current through the error amplifier 202 scales proportionally with load current. This makes the design more efficient than the conventional topology under varying loads.

Another challenge in regulator design is stability. The nets $V_{BP}$ and $V_{REG}$ both add pole frequencies to the transfer function. Either one pole or the other must dominate for a stable system, however. For regulators supplying a voltage to a PLL, maximizing the output load capacitance reduces the amount of ripple on $V_{REG}$. Thus, it is preferable that the pole frequency at $V_{REG}$ dominate. One method of improving stability is reducing the gain of the error amplifier 202 by adding diode-connected transistor $G_2$ to the output terminal 216 of the error amplifier 202 as BW enhancement 208. By changing the ratio for transistor $G_1$, $G_2$ to $B_1$, $B_2$, the circuit designer can tune the gain, and the pole can be pushed out to a higher frequency, providing bandwidth enhancement. At the same time, the output pole becomes dominate and stability is ensured. A second diode-connected transistor $G_1$ is added to the left side of the error amplifier 202 for matching so that the total size of the transistors on the left and right sides of the error amplifier 202 are the same.

The resistor-capacitor (RC) network consisting of $R_B$ and $C_B$ provides stability to the adaptive bias network 212. The network 212 adds a positive feedback loop with a high bandwidth because the net $V_A$ between transistors C and D does not have a large capacitance unlike the net $V_{REG}$. Adding the RC network $R_B$,$C_B$ introduces a pole and zero to the network 212 to provide stability in the overall system.

The LDO voltage regulator 200 includes an auxiliary bias network 210 that functions to prevent bistable operation and ensure startup. The auxiliary bias network 210 includes resistor $R_F$ connected at one end to $V_{DD}$, which provides current through the current mirror of transistor F to transistor E. The drain terminal of transistor F connects to the other end of resistor $R_F$. The source terminals of transistors F and E are connected to ground. The drain terminal of transistor E is connected to node 214 connecting the source terminals of transistor pair $N_1$, $N_2$ of the error amplifier 202. The auxiliary bias current is small because it does not need to be large to ensure that the circuit powers-up. Additionally, a small auxiliary current does not significantly affect the operation of the adaptive bias network 212.

Figure 3:
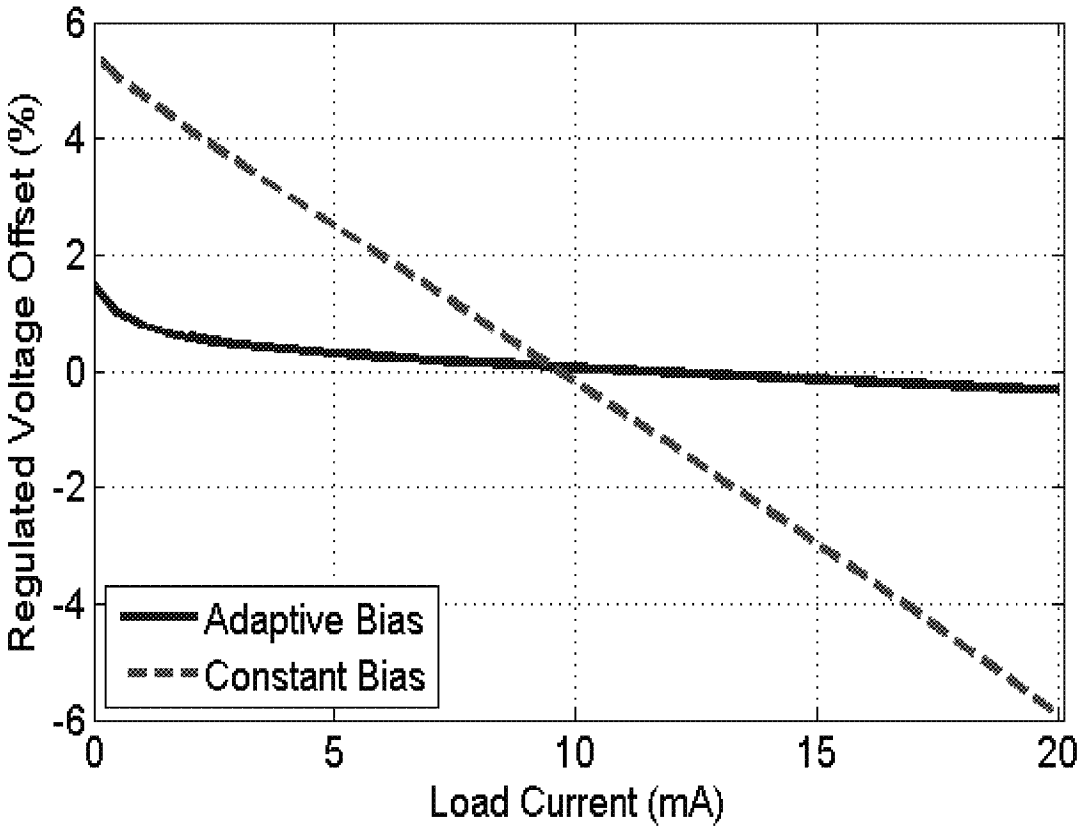
FIG. 3 illustrates an example plot of regulated voltage offset versus load current.

FIG. 3 shows the regulated voltage offset versus the output load current for two different LDO regulator topologies. The first LDO regulator topology, indicated by the dashed line, uses a constant bias current like those found in conventional voltage regulators. Over a large range in current loads, the regulated voltage varies by approximately 12%. The second LDO regulator topology, indicated by the solid line, uses the adaptive bias current approach described in connection with the present disclosure, such that the regulated voltage now only varies by approximately 2%.

Figure 4:
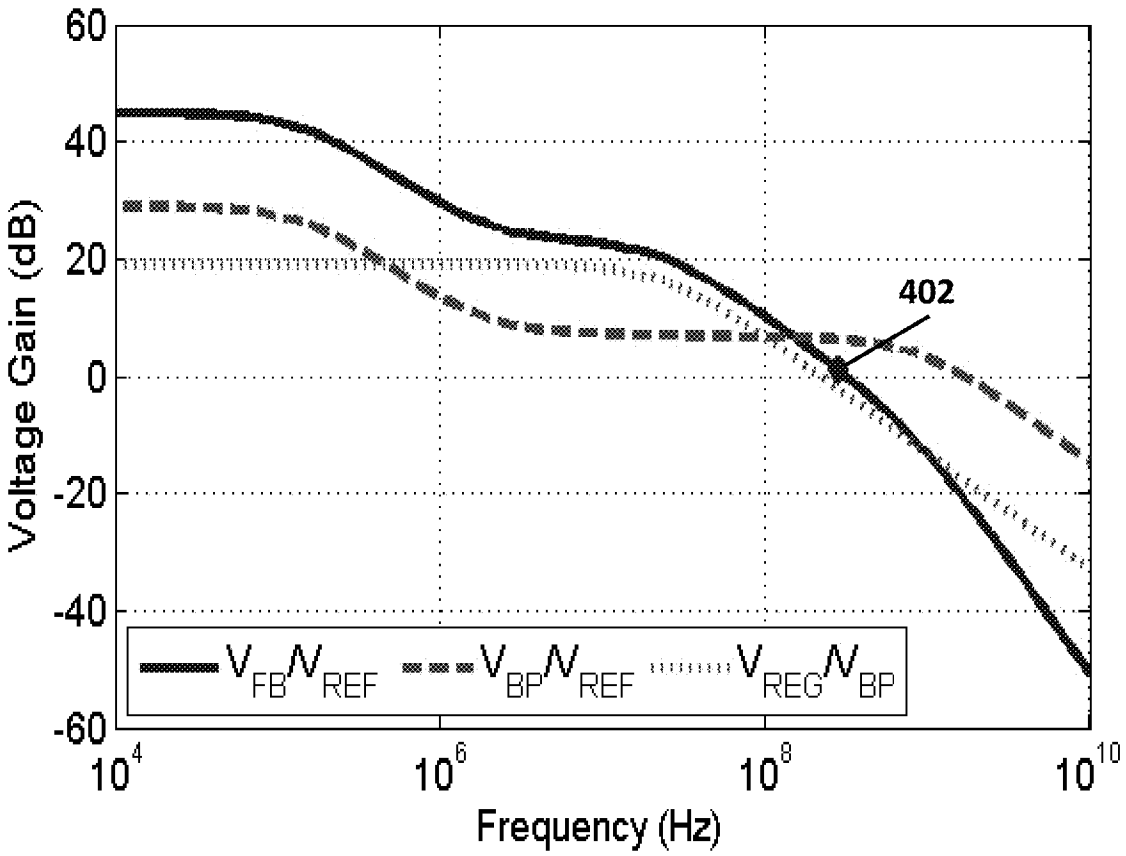
FIG. 4 illustrates an example plot of voltage gain versus frequency.

FIG. 4 illustrates an example plot of voltage gain versus frequency. In particular, the plot shows the magnitude response of the voltage regulator 200 between several different nets. The dotted line shows the voltage gain of the pass gate transistor 204, $V_{REG}/N_{BP}$. The pass gate transistor 204 is an amplifier with a single pole frequency. The dashed line depicts the voltage gain of the error amplifier 202, $V_{BP}/V_{REF}$, and includes the effect of the adaptive bias network 212. Unlike a traditional error amplifier, which has a single pole frequency, the error amplifier 202 has two pole frequencies and one zero frequency. The high frequency pole is created by transistor pair G, which provides bandwidth extension and stability. The transistor pair G also decreases the DC gain of the error amplifier 202, which contributes to the large regulated voltage offset of the dashed line with constant bias current in FIG. 3. The addition of the pole and zero frequency by the RC network $R_B$,$C_B$ in the adaptive bias network 212 allows the voltage regulator 200 to increase the DC gain of the error amplifier 202 and reduce the regulated voltage offset in FIG. 3.

Turning again to FIG. 4, the overall loop gain of the voltage regulator 200 is given by the solid line, $V_{FB}/V_{REF}$. This overall loop gain corresponds to the mathematical summation of the pass gate, error amplifier, and resistor divider voltage gains and represents the overall magnitude response that can be used for stability analysis. A diamond 402 represents the frequency at which the gain crosses 0 dB, also called the gain-bandwidth product (GBP).

Figure 5:
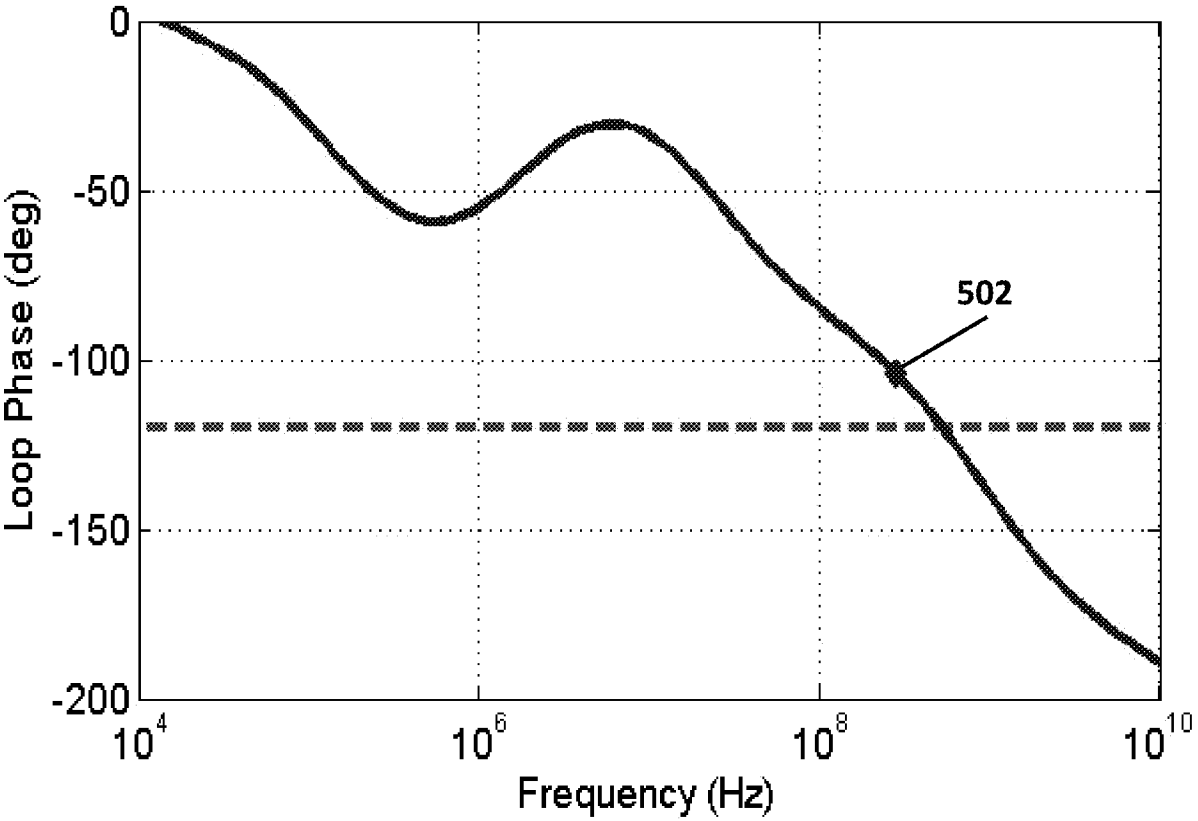
FIG. 5 illustrates an example plot of loop phase versus frequency.

FIG. 5 illustrates an example plot of loop phase versus frequency for the voltage regulator 200. Because the corresponding diamond 502 is >−120° (i.e. the dashed line), the system is considered stable.

Those skilled in the art will appreciate that there are other alternatives to the MOS transistors for the embodiments disclosed herein. Other type and other combination of transistors can be employed to implement the functions of the error amplifier 202, the auxiliary bias network 210, the main adaptive bias network 212, and the pass gate 204 without departing from the spirit of the present disclosure.

While this invention has been particularly shown and described with references to example embodiments thereof, it will be understood by those skilled in the art that various changes in form and details may be made therein without departing from the scope of the invention encompassed by the appended claims.

What is claimed is:

1. A low drop-out (LDO) voltage regulator comprising:

an error amplifier configured to generate an amplified error voltage, the error amplifier having a first input terminal for receiving a reference voltage, a second input terminal for receiving a feedback voltage, a current bias terminal for receiving an adaptive bias current, and an output terminal;

a pass gate configured to provide an output voltage to at least one external component, the pass gate having a first input terminal, a second input terminal and an output terminal, the first input terminal of the pass gate being connected to a supply voltage and the second input terminal being connected to the output terminal of the error amplifier;

a voltage feedback network configured to generate the feedback voltage, the voltage feedback network having a first terminal connected to the output terminal of the pass gate and a second terminal connected to the second input terminal of the error amplifier; and an adaptive bias network configured to provide the adaptive bias current to the error amplifier, the adaptive bias network having a first transistor, a second transistor, and a third transistor, the first transistor connected to the current bias terminal of the error amplifier, the second transistor connected to the first transistor as a current mirror, and the third transistor having a first input terminal connected to the supply voltage and a second input terminal connected to the second input terminal of the pass gate.

2. The LDO voltage regulator of claim 1, wherein the adaptive bias current through the first transistor is proportional to a current through the second transistor, a current through the third transistor is proportional to an output load current, and a current through the error amplifier scales proportionally with the output load current.

3. The LDO voltage regulator of claim 1, further comprising an auxiliary bias network connected to the current bias terminal of the error amplifier to prevent bistable operation.

4. The LDO voltage regulator of claim 3, wherein the auxiliary bias network comprises a resistor, a fourth transistor, and a fifth transistor, the resistor having a first terminal connected to the supply voltage and a second terminal connected to the fourth transistor, the fourth transistor connected to the fifth transistor as a current mirror, and the fifth transistor connected to the current bias terminal of the error amplifier.

5. The LDO voltage regulator of claim 1, wherein the error amplifier includes a diode-connected transistor connected to the output terminal of the error amplifier that is configured to have a size selected to enhance bandwidth of the error amplifier.

6. The LDO voltage regulator of claim 1, wherein the adaptive bias network includes a resistor-capacitor network configured to provide stability to the LDO voltage regulator.

* * * * *